US005564142A

United States Patent [19]

Liu

[11] Patent Number: 5,564,142

[45] Date of Patent: Oct. 15, 1996

[54] AIR MATTRESS COLLABORATIVELY CUSHIONED WITH PULSATIVE AND STATIC SYMBIOTIC SACS

[76] Inventor: Tsung-Hsi Liu, c/o Hung Hsing Patent Service Center P.O. Box 55-1670, Taipei, Taiwan

[21] Appl. No.: 439,511

[22] Filed: May 11, 1995

[51] Int. Cl.[6] ..... A47C 27/08

[52] U.S. Cl. ..... 5/689; 5/933; 5/710; 5/706

[58] Field of Search ..... 5/453, 455, 456, 5/468, 469, 914, 449, 933

[56] References Cited

U.S. PATENT DOCUMENTS

| | | | |
|---|---|---|---|
| 1,772,310 | 8/1930 | Hart | 5/914 |
| 3,199,124 | 8/1965 | Grant . | |
| 3,446,203 | 5/1969 | Marray . | |
| 3,462,778 | 8/1969 | Whitney . | |
| 3,467,081 | 9/1969 | Glass . | |
| 3,587,568 | 6/1971 | Thomas . | |
| 3,653,083 | 4/1972 | Lapidus . | |
| 3,674,019 | 7/1972 | Grant . | |
| 3,678,520 | 7/1972 | Evans . | |
| 3,701,173 | 10/1972 | Whitney . | |
| 4,114,620 | 9/1978 | Moore . | |
| 4,175,297 | 11/1979 | Robbins . | |
| 4,193,149 | 3/1980 | Welch . | |
| 4,197,837 | 4/1980 | Triangali . | |
| 4,225,989 | 10/1980 | Corbett . | |
| 4,267,611 | 5/1981 | Agulnick . | |
| 4,279,044 | 7/1981 | Dauglas . | |
| 4,280,487 | 7/1981 | Jackson . | |
| 4,347,633 | 9/1982 | Gammons . | |
| 4,391,009 | 7/1983 | Schild . | |
| 4,425,676 | 1/1984 | Crane . | |
| 4,472,847 | 9/1984 | Gammons . | |
| 4,483,030 | 11/1984 | Flick . | |
| 4,524,762 | 6/1985 | Schulman . | |
| 4,551,874 | 11/1985 | Matsamura . | |
| 5,109,560 | 5/1992 | Uetake | 5/453 |
| 5,109,561 | 5/1992 | Schild | 5/455 |
| 5,311,623 | 5/1994 | Hendi | 5/455 |
| 5,367,728 | 11/1994 | Chang | 5/453 |

*Primary Examiner*—Steven N. Meyers
*Assistant Examiner*—Tuyet-Phuong Pham

[57] ABSTRACT

An air mattress includes a plurality of symbiotic sacs juxtapositionally transversely secured in a mattress envelope, having a plurality of primary and secondary symbiotic sacs alternatively pulsated in the envelope for continuously changing the pressurized areas of a bed-ridden patient for preventing pressure sores such as bed sore or decubitus ulcer, with each symbiotic sac consisting of an upper pulsating sac portion alternatively inflated and deflated and a lower static sac portion constantly inflated to maintain at least a partial fluid pressure in each symbiotic sac for continuously cushioning the patient even when a power failure is caused or bed transfer is required, and having a plurality of tertiary symbiotic sacs constantly inflated for cushioning a patient head portion, with each symbiotic sac independently secured in the mattress envelope whereby upon breaking of any one sac, only an individual broken sac should be replaced with a new one without abandoning the whole mattress.

6 Claims, 4 Drawing Sheets

AIR MATTRESS COLLABORATIVELY CUSHIONED WITH PULSATIVE AND STATIC SYMBIOTIC SACS

BACKGROUND OF THE INVENTION

U.S. Pat. No. 4,225,989 to Corbett et al. disclosed a ripple bed having an upper and a lower inflatable layer. The upper layer has separate air passages inflatable and deflatable to provide the rippling effect, and the lower layer is separately inflatable to provide support over the area of the upper layer when deflated. However, once the lower layer is broken such as pricked by an article of sharp end, the whole bed shall be invalidated and may be abandoned to waste money. The lower layer is formed by the upper and lower sheets to be a complete pad which may not be well bent, thereby being unsuitable for adjusting any bending position for a hospital mattress.

A dual layer cellular inflatable pad of U.S. Pat. No. 3,674,019 disclosed by Grant includes a first inflatable cellular layer having a plurality of cells for inflation, and a second cellular cushioning layer alternately interfitted with the cells of the first inflatable cellular layer in tangential relationship with each other. In order to prevent a relative shear movement of the Grant pad, each upper cell should be positioned in between two lower cells in tangential relationship therebetween for a stable supporting of the upper layer by the lower layer. Therefore, a precise production and quality control is required to maintain the tangential contacts between the upper cells and the lower cells of the upper and lower layers, possibly causing production complexity and increasing fabrication cost therefor. Meanwhile, once the cellular structure of either upper layer or lower layer is broken, the whole pad will be leaked and may be completely abandoned to waste money and influence environmental protection.

SUMMARY OF THE INVENTION

The object of the present invention is to provide an air mattress including a plurality of symbiotic sacs juxtapositionally transversely secured in a mattress envelope or pouch, having a plurality of primary and secondary symbiotic sacs alternatively pulsated in the envelope for continuously changing the pressurized spots of a bed-ridden patient for preventing pressure sores such as bed sore or decubitus ulcer, with each symbiotic sac consisting of an upper pulsating sac portion alternatively inflated and deflated and a lower static sac portion constantly inflated to maintain at least a partial fluid pressure in each symbiotic sac for continuously cushioning the patient even when a power failure is caused or bed transfer is required, and having a plurality of tertiary symbiotic sacs constantly inflated for cushioning a patient head portion, with each symbiotic sac independently secured in the mattress envelope, whereby upon breaking of any one sac, only an individual broken sac is replaced with a new one without abandoning the whole mattress.

DETAILED DESCRIPTION

Figure 1:
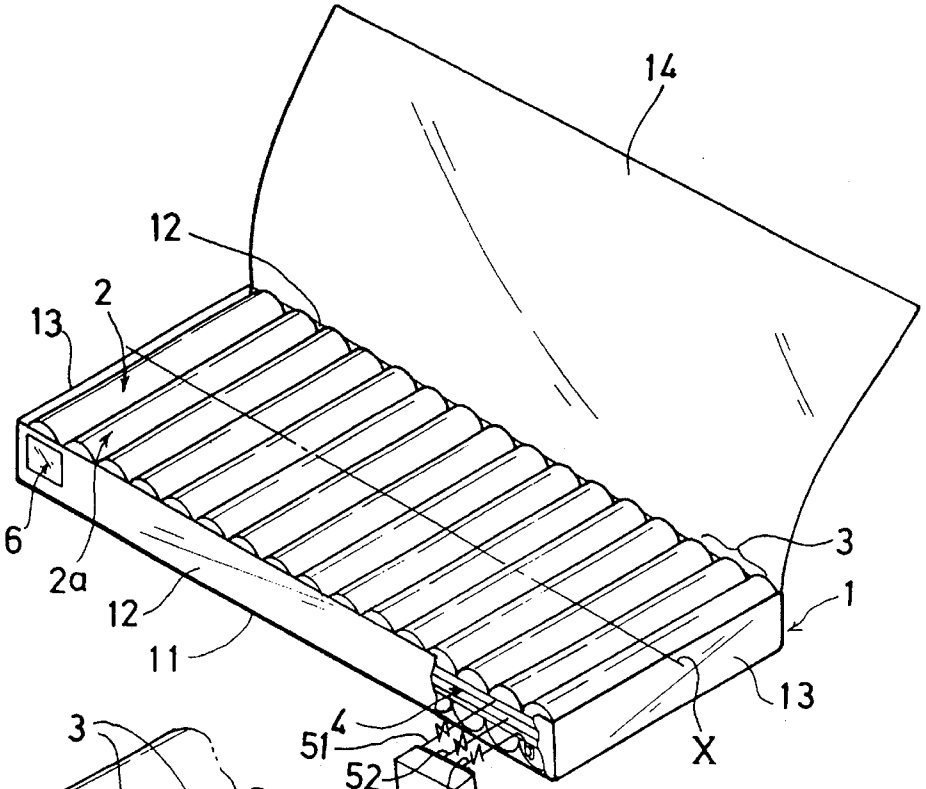
FIG. 1 is perspective view of the present invention.
Figure 2:
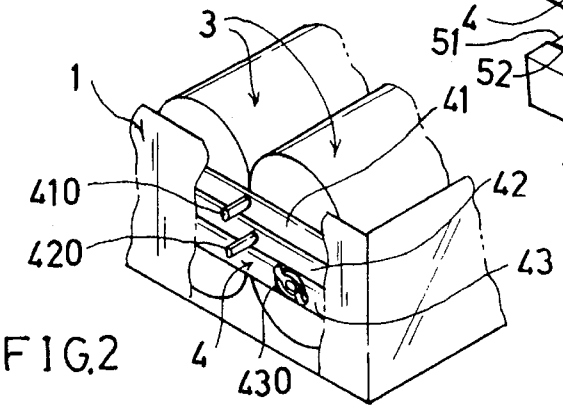
FIG. 2 is a partial enlarged illustration of a fluid distributing means of the present invention.
Figure 3:
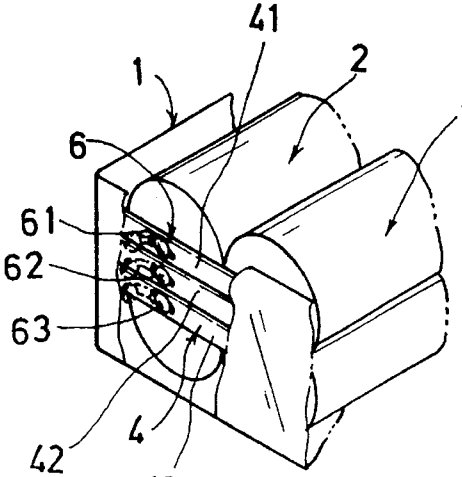
FIG. 3 is an illustration showing an emergency releasing means of the present invention.

As shown in FIGS. 1–8, the present invention comprises: a mattress envelope or pouch 1; a plurality of primary symbiotic sacs 2; a plurality of secondary symbiotic sacs **2*a*; a plurality of tertiary symbiotic sacs 3; a fluid distributing means 4 for transferring a fluid such as air to and from the sacs 2, 2*a*, 3; a pumping means 5 which may be a pump, a blower or a compressor; and an emergency releasing means 6. The primary and secondary symbiotic sacs 2, 2*a*** are provided to cushion a patient's body or torso T.

The mattress envelope 1 includes: a bottom 11, a pair of longitudinal side walls 12 and a pair of transverse side walls 13 combinably forming a rectangular shape, and a top cover 14 closing the side walls 12, 13 such as by means of zippers for storing the sacs 2, **2*a*, 3 in the envelope 1**.

The primary symbiotic sacs 2 are alternately transversely secured in the mattress envelope 1 to be perpendicular to a longitudinal axis X existing at a longitudinal center of the envelope 1.

The secondary symbiotic sacs **2*a* are alternately transversely secured in the envelope 1 to allow each secondary sac 2*a* to be adjacent to each primary sac 2**.

The tertiary symbiotic sacs 3 are juxtapositionally secured in an end portion of the envelope 1 such as for cushioning a patient's head portion H.

Each primary symbiotic sac 2 includes: a central diaphragm 21, an upper pulsating portion 22 positioned above the central diaphragm 21 and defining an upper chamber U communicated with the fluid distributing means 4 through a first upper adapter 221 formed on the upper pulsating portion 22, a lower static portion 23 positioned below the central diaphragm 21 and the upper pulsating portion 22 and defining a lower chamber D independently separated from the upper chamber U and communicated with the fluid distributing means 4 through a first lower adapter 231 formed on the lower static portion 23, and at least a joint member 24 for fastening the primary symbiotic sac 2 to the mattress envelope 1. The joint member 24 may be selected from a fastener, a rope, a strip, or may be modified by integrally forming each primary sac 2 with the envelope 1.

Each sac 2 may be formed to have a cross section of an elliptic, circular or lobe shape, but not limited in this invention.

Figure 9:
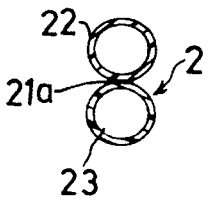
FIG. 9 is a cross sectional drawing of another preferred embodiment of the sac of the present invention.

The sac 2 may be modified to include an upper pulsating sac portion 22 and a lower static sac portion 23 having a coupling element 21*a* such as adhesive bonding, ultrasonic joining or welding by electric heat for joining the upper and lower sac portions 22, 23 as shown in FIG. 9.

Each secondary symbiotic sac 2*a* is generally equivalent to the primary sac 2 and includes: a central diaphragm 21, an upper pulsating portion 22 positioned above the central diaphragm 21 and defining an upper chamber U communicated with the fluid distributing means 4 through a second upper adapter 222 formed on the upper pulsating portion 22 and being projectively lower than a position of the first upper adapter 221 on the primary sac 2, a lower static portion 23 positioned below the central diaphragm 21 and the upper pulsating portion 22 and defining a lower chamber D independently separated from the upper chamber U and communicated with the fluid distributing means 4 through a second lower adapter 232 formed on the lower static portion 23, and at least a joint member 24 for fastening the secondary symbiotic sac 2*a* to the mattress envelope 1.

Each tertiary symbiotic sac 3 similar to the primary or secondary sac 2, 2*a* includes: a central perforated diaphragm 31 having a plurality of perforations 311 drilled in the perforated diaphragm 31, an upper sac portion 32 and a lower sac portion 33 disposed on an upper and a lower side of the central perforated diaphragm 31, a filling adapter 30 formed on the lower sac portion 33 and communicated with the fluid distributing means 4, and a joint member 34 for securing each sac 3 to the envelope 1.

The fluid distributing means 4 includes: a first conduit 41, a second conduit 42, and a third conduit 43 juxtapositionally longitudinally formed in the mattress envelope 1 and respectively communicated with the pumping means 5 of a fluid source; the first conduit 41 having a first connector 410 connectable with a first delivery tube 51 of the pumping means 5 and having a plurality of first branch tubes 411 equally spaced and longitudinally distributed on the first conduit 41 with each first branch tube 411 connected with each first upper adapter 221 of each primary symbiotic sac 2 for delivering fluid between the upper pulsating portion 22 of each primary symbiotic sac 2 and the pumping means 5; the second conduit 42 having a second connector 420 connectable with a second delivery tube 52 of the pumping means 5 and having a plurality of second branch tubes 421 equally spaced and longitudinally distributed on the second conduit 42 with each second branch tube 421 connected with each second upper adapter 222 of each secondary symbiotic sac 2*a* for delivering fluid between the upper pulsating portion 22 of each secondary symbiotic sac 2*a* and the pumping means 5; and the third conduit 43 having a sealing valve 430 connectable with a third delivery tube 53 of the pumping means 5 through a check valve 5*a* formed on the third delivery tube 53 for delivering fluid into the third conduit 43 for preventing backflow into the pumping means 5, and having a plurality of filling tubes 431 equally spaced and longitudinally distributed on the third conduit 43 with each filling tube 431 connected with each filling adapter 30 of each tertiary symbiotic sac 3 or connected with each lower adapter 231, 232 of each primary and secondary symbiotic sac 2, 2*a* for filling fluid into each tertiary symbiotic sac 3 and each lower static portion 23 of each primary and secondary symbiotic sac 2, 2*a*.

An upper portion of each primary and secondary symbiotic sac 2, 2*a* may be perforated with a plurality of fine perforations such as four perforations each having a diameter of 0.1+0.05 mm as pierced by laser beam for well ventilating a patient's body as cushioned on the mattress of this invention.

The pumping means 5 may include a selector valve (not shown) having a plurality of ports, which may be automatically controlled by several selective control modes to control the alternatively pulsating movements of the primary and secondary sacs 2, 2*a*.

The pumping means 5 is connected to a fluid (such as air) source. If a utility compressed air supply system is provided in a hospital, the pump or blower inside the pumping means 5 may then be omitted.

The emergency releasing means 6 includes: a first relief valve 61 connected to the first conduit 41 of the fluid distributing means 4, a second relief valve 62 connected to the second conduit 42 of the fluid distributing means 4, and a third relief valve 63 connected to the third conduit 43 of the fluid distributing means 4, whereby upon opening of the relief valves 61, 62, 63, the fluid (air) in the sacs 2, 2*a*, 3 will be instantly released for descending a patient's body to be stably rested on the bed for cardiopulmonary resuscitation (CPR).

Figure 5:
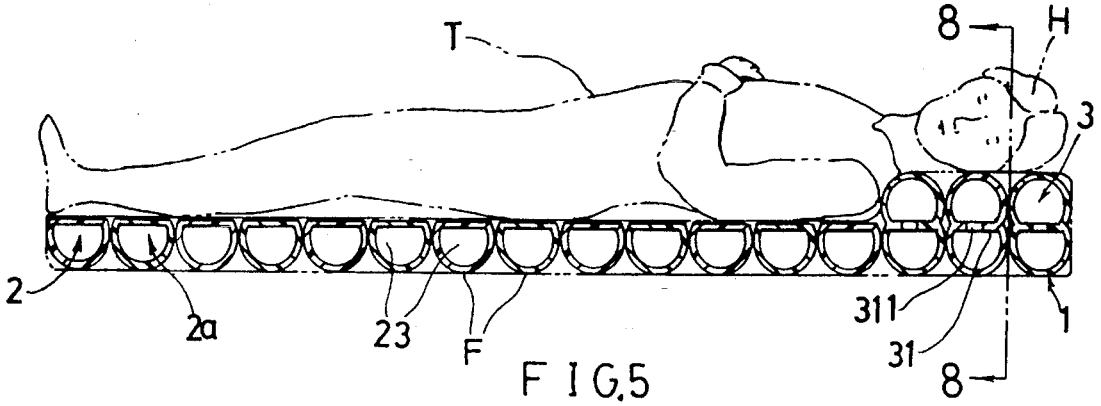
FIG. 5 is a sectional drawing showing partially deflated sacs of the present invention.
Figure 6:
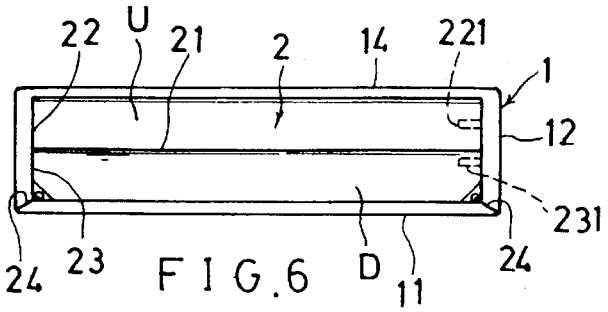
FIG. 6 is a front view of the primary symbiotic sac of the present invention when viewed from 6—6 direction of FIG. 4.
Figure 7:
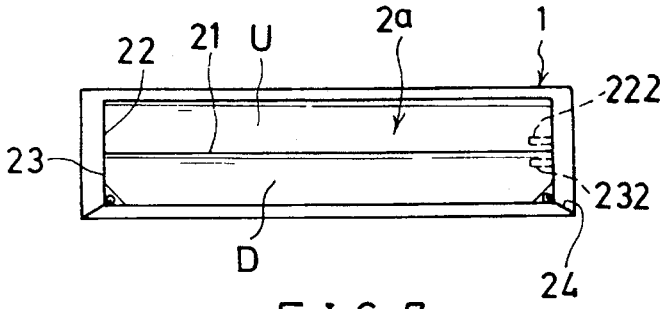
FIG. 7 is a front view of the secondary symbiotic sac of the present invention when viewed from 7—7 direction of FIG. 4.
Figure 8:
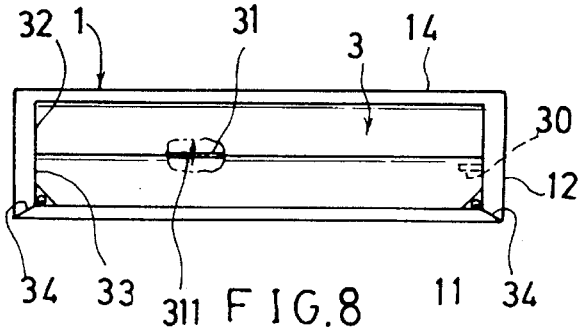
FIG. 8 is a front view of the tertiary symbiotic sac of the present invention when viewed from 8—8 direction of FIG. 5.

When using the present invention, the fluid (air) is pumped into the tertiary symbiotic sacs 3 and the lower static portion 23 of each primary and secondary symbiotic sac 2, 2*a* for inflating all lower static portions 23 of the sacs 2, 2*a* and all tertiary sacs 3, whereby upon exhausting of the air in the upper pulsating portions 22 of the primary and secondary sacs 2, 2*a* due to power failure or bed transfer, all lower portions 23 of the sacs 2, 2*a* are inflated to uninterruptedly cushion a patient's torso T and the sacs 3 are also inflated to cushion the patient's head H as shown in FIG. 5 to ensure a comfortable uninterrupted cushioning for the bed-ridden patient.

Once inflating the lower sac portions of the primary and secondary sacs 2, 2*a* and the whole tertiary sacs 3, each sac 3 having an upper sac portion 32 communicating with the lower sac portion 33, by the pumping means 5, the fluid will not backflow to thereby continuously inflate the lower sac portions of the sacs 2, 2*a* and the full sacs 3 as shown in FIG. 5. Even though the third delivery tube 53 of the pumping means 5 is disconnected, the sealing valve 430 of the third conduit 43 may be closed to prevent any fluid leakage therefrom, thereby keeping a saturation of fluid pressure in the lower sac portions 23 of the sacs 2, 2*a* and the full sacs 3.

Figure 4:
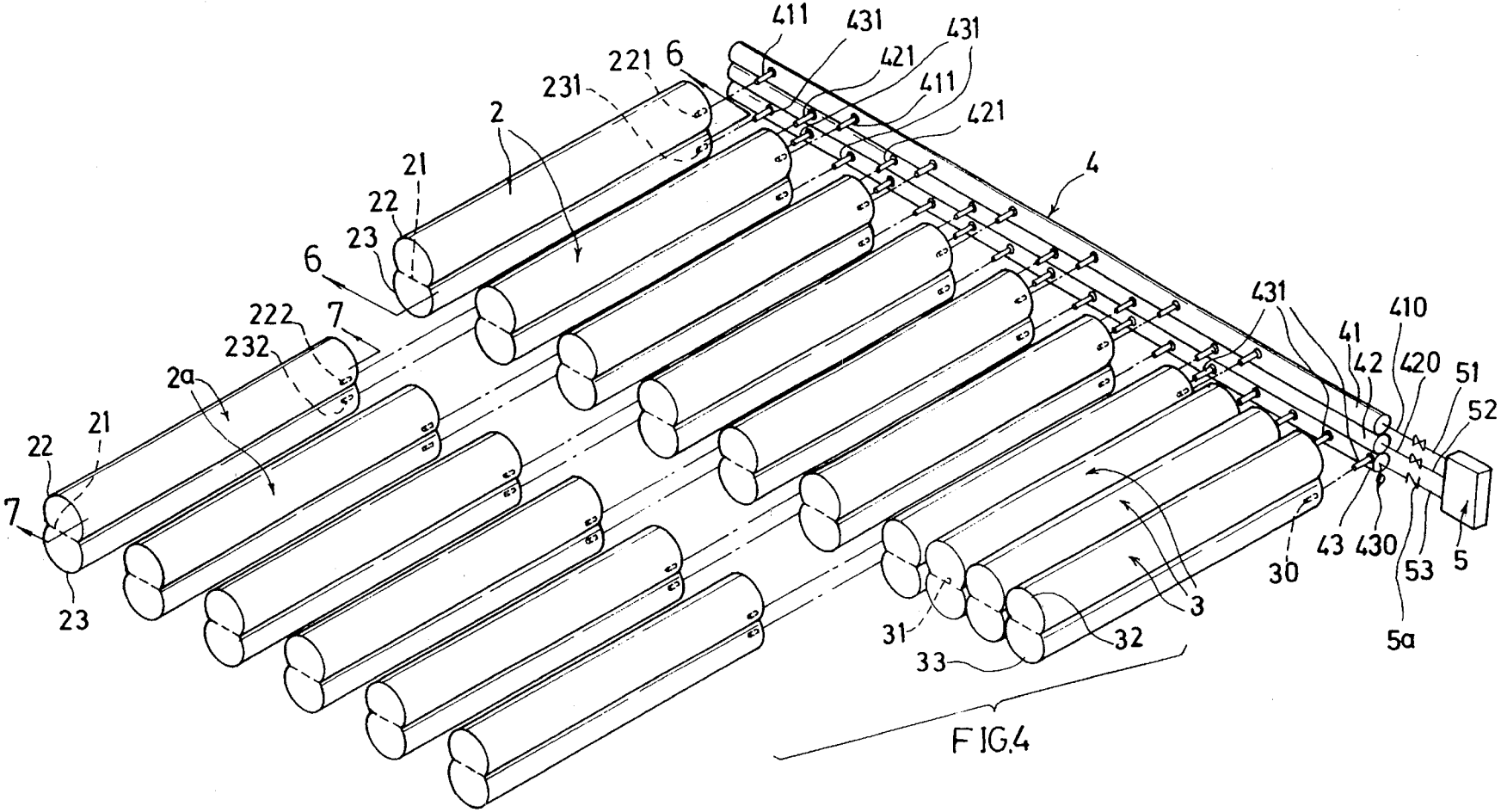
FIG. 4 is an exploded perspective view of the present invention.
Figure 4A:
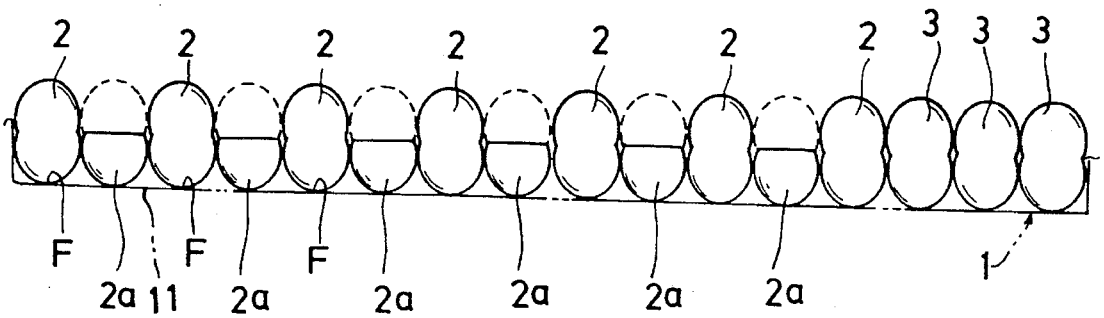
FIG. 4A is an illustration showing inflated primary symbiotic sacs of the present invention.
Figure 4B:
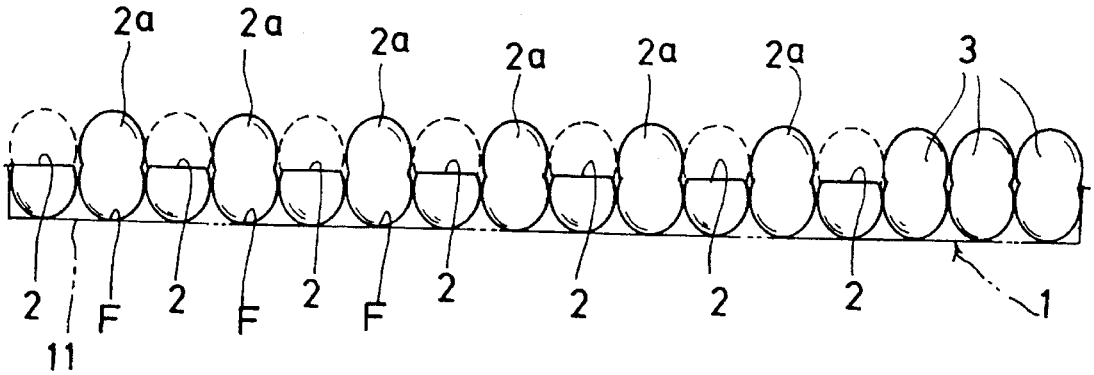
FIG. 4B shows inflated secondary symbiotic sacs of the present invention.

Upon an alternative inflation and deflation of the primary and secondary sacs as shown in FIGS. 4A and 4B, a rippling or pulsating movement of the primary and secondary sacs 2, 2*a* will be effected to decrease the pressure contact of the patient's body and the mattress to prevent pressure sores.

Each upper sac portion 22 of the primary or secondary symbiotic sac 2, 2*a* is vertically pulsated above its lower sac portion 23, and directly supported on the lower sac portion 23. Each upper sac portion 22 is symbiotically linked with the lower sac portion 23, thereby preventing a relative shear displacement of the upper sac portion 22 to the lower sac portion 23 to be beneficial for the rippling movement of the primary and secondary sacs 2, 2*a*.

Each symbiotic sac 2, 2*a* of the present invention has a bottom portion F resting on a bottom 11 of the envelope 1, with each bottom portion F of the sac 2, 2*a* serving as a "fulcrum" to thereby allow a flexible bending of the mattress for an optional angular adjustment of a hospital mattress to be superior to the conventional ripple pad having a "rigid" sheet layer which is not easy to be flexibly bent.

Since each sac 2, 2*a*, 3 of the present invention is individual and independent to anyone of its neighboring sac, anyone sac, once being broken, can be individually replaced with a new one without deleting or abandoning the whole mattress for saving cost and for better environmental protection.

Each lower sac portion 23 of the primary and secondary sacs 2, 2*a* of this invention, once being inflated and closed, will no longer require the inlet fluid so that the volumetric rate of the pumping means 5 can be reduced to save its driving energy for economic purpose.

The dimensions of the mattress of the present invention can be optionally chosen by varying the number of independment separable symbiotic sacs 2, 2*a*, 3 without integrally forming a fixed cellular layer like a conventional ripple pad, thereby optimizing a plant production flexibility.

The present invention may be modified without departing from the spirit and scope as claimed in this invention. The envelope 1 may also be formed as a pouch, a bag, a housing or a box made of flexible air-permeable material.

I claim:

1. An air mattress comprising:

a mattress envelope defining a longitudinal axis at a longitudinal center of the envelope;

a plurality of primary and secondary symbiotic sacs juxtapositionally transversely secured in said envelope for cushioning a patient's torso and generally perpendicular to said longitudinal axis of said envelope, said plurality of primary symbiotic sacs alternately secured in said envelope having each said primary symbiotic sac positioned adjacent to each said secondary symbiotic sac;

a plurality of tertiary symbiotic sacs juxtapositionally transversely secured in an end portion of said envelope for cushioning a patient's head portion;

a fluid distributing means connected to and fluidically communicating with said primary, secondary and tertiary sacs; and a pumping means connectable to said fluid distributing means and connected to a fluid source for pumping the fluid into said primary, secondary and tertiary sacs through said fluid distributing means;

said primary and secondary symbiotic sacs each including: an upper pulsating portion defining an upper chamber communicated with the fluid distributing means through an upper adapter formed on the upper pulsating portion, a lower static portion positioned below the upper pulsating portion and defining a lower chamber independently separated from the upper chamber and communicated with the fluid distributing means through a lower adapter formed on the lower static portion;

each said tertiary symbiotic sac including: a central perforated diaphragm having a plurality of perforations drilled in the perforated diaphragm, an upper sac portion and a lower sac portion disposed on an upper and a lower side of the central perforated diaphragm, and a filling adapter formed on the lower sac portion and communicated with the fluid distributing means; whereby upon an alternatively inflating and deflating of the upper pulsating portions of said primary and secondary symbiotic sacs, a rippling movement of said primary and secondary sacs will be effected for changing a pressure contact between a patient body and the mattress; and upon inflation of said lower static portions of said primary and secondary sacs and inflation of said tertiary sacs, a continuous uninterrupted saturation of a fluid pressure will be kept therein for comfortably cushioning the patient's body.

2. An air mattress according to claim 1, wherein said primary and secondary symbiotic sacs each include a central diaphragm partitioned between said uppper pulsating portion and said lower static portion.

3. An air mattress according to claim 1, wherein said upper pulsating portion is symbiotically linked with said lower static portion by a coupling element.

4. An air mattress according to claim 1, wherein said primary, secondary, and tertiary symbiotic sacs each include a joint member formed on a portion of each said sac for securing each said sac to said mattress envelope.

5. An air mattress according to claim 1, wherein said fluid distributing means includes: a first conduit, a second conduit, and a third conduit juxtapositionally longitudinally formed in the mattress envelope and respectively communicated with the pumping means; the first conduit having a first connector connectable with a first delivery tube of the pumping means and having a plurality of first branch tubes equally spaced and longitudinally distributed on the first conduit with each said first branch tube connected with each said upper adapter of each said primary symbiotic sac for delivering fluid between the upper pulsating portion of each said primary symbiotic sac and the pumping means; the second conduit having a second connector connectable with a second delivery tube of the pumping means and having a plurality of second branch tubes equally spaced and longitudinally distributed on the second conduit with each said second branch tube connected with each said upper adapter of each said secondary symbiotic sac for delivering fluid between the upper pulsating portion of each said secondary symbiotic sac and the pumping means; and the third conduit having a sealing valve connectable with a third delivery tube of the pumping means through a check valve formed on the third delivery tube for delivering fluid into the third conduit for preventing backflow into the pumping means, and having a plurality of filling tubes equally spaced and longitudinally distributed on the third conduit with each said filling tube connected with a filling adapter formed on each said tertiary symbiotic sac and connected with a lower adapter formed on each said primary and secondary symbiotic sac for filling fluid into each said tertiary symbiotic sac and each said lower static portion of each said primary and secondary symbiotic sac.

6. An air mattress according to claim 1, wherein said primary and secondary symbiotic sacs each have an upper portion thereof perforated with a plurality of fine perforations for ventilating a patient's body as cushioned on the mattress.

* * * * *